United States Patent [19]

Saijo et al.

[11] Patent Number: 4,940,014

[45] Date of Patent: Jul. 10, 1990

[54] DEVELOPING DEVICE

[75] Inventors: Hiromitsu Saijo; Masamichi Hayashi; Takeji Morikawa, all of Osaka, Japan

[73] Assignee: Minolta Camera Kabushiki Kaisha, Osaka, Japan

[21] Appl. No.: 251,083

[22] Filed: Sep. 29, 1988

[30] Foreign Application Priority Data

Sep. 29, 1987 [JP] Japan ..... 62-245285

[51] Int. Cl.[5] ..... G03G 15/09

[52] U.S. Cl. ..... 118/658; 355/251; 355/253

[58] Field of Search ..... 118/657, 658, 612; 355/140, 300

[56] References Cited

U.S. PATENT DOCUMENTS

| | | | |
|---|---|---|---|
| 4,131,357 | 12/1978 | Forbes | 355/251 |
| 4,147,426 | 4/1979 | Miyoshi et al. | 355/309 |
| 4,173,405 | 11/1979 | Swapceinski et al. | 355/260 |
| 4,435,065 | 3/1984 | Wada | 355/245 |
| 4,582,414 | 4/1986 | Wakefield et al. | 355/253 |
| 4,777,512 | 10/1988 | Takahashi et al. | 355/208 |

*Primary Examiner*—A. T. Grimley

*Assistant Examiner*—Robert Beatty

*Attorney, Agent, or Firm*—Wenderoth, Lind & Ponack

[57] ABSTRACT

A developing device includes a casing having a sleeve chamber, an upper chamber and a lower chamber, a developing sleeve housed within the sleeve chamber with a portion of the outer peripheral surface spaced a distance from a photoreceptor drum to define a developing station, and a screw feeder operatively housed within each of the upper and lower chambers. A partition wall separates the upper and lower chambers from each other and has a port defined in a downstream end with respect to the direction of conveyance of the developing material within the lower chamber for placing the upper and lower chambers in communication with each other. A plurality of magnets are accommodated inside the developing sleeve so as to extend in a direction longitudinally of the developing sleeve while positioned circumferentially of the developing sleeve. A weak magnetic pole is disposed at a region confronting the screw feeder within the lower chamber and a strong magnetic pole is disposed at a region corresponding to the port in the partition wall member and longitudinally of the weak magnetic pole.

15 Claims, 5 Drawing Sheets

DEVELOPING DEVICE

BACKGROUND OF THE INVENTION

1. Field of the Invention

The present invention relates to a powder-image developing device utilized in an image forming apparatus capable of performing an electrophotographic copying process, such as, for example, a copying machine, a printer or the like.

2. Description of the Prior Art

Hitherto, a developing device such as shown in FIGS. 6 and 7 has been proposed. Referring to FIGS. 6 and 7 which are a side sectional view of the developing device taken in a direction perpendicular to the axis of rotation of a photoreceptor drum and a perspective view of a portion of the developing device, respectively, the illustrated developing device 20 comprises a generally box-like casing 21 having defined therein a sleeve chamber in which a developing sleeve 22 is rotatably supported with a portion of the outer periphery thereof exposed to and confronting the photoreceptor drum 100 on which a latent image is formed. A magnetic roller 23 is coaxial to and fixedly disposed inside the developing sleeve 22 and comprises a plurality of magnetic pole members S1 to S3 and N1 to N3 disposed circumferentially thereon in an alternating fashion as shown.

The casing 21 also has upper and lower chambers 24 and 25 defined therein one above the other on one side of the developing sleeve 22 remote from the photoreceptor drum 100. The upper and lower chambers 24 and 25 are substantially partitioned by a partition wall 26 having opposite ends connected, or otherwise formed integrally, with opposite end walls of the casing 21 so as to extend in a direction generally parallel to the longitudinal axis of the developing sleeve 22. The partition wall 26 has a width so selected as to define elongated openings 27 and 28 on respective sides thereof, though which the upper and lower chambers 24 and 25 communicate with each other.

As best shown in FIG. 7, screw feeders 29 and 30 are rotatably supported within the upper and lower chambers 24 and 25. The screw feeder 29 is driven in a direction opposite to the direction of rotation of the screw feeder 30 so that a developing material conveyed by the screw feeder 29 in one direction Y1 within the upper chamber 24 can be conveyed by the screw feeder 30 in the opposite direction Y2 within the lower chamber 25. The developing material utilized in the illustrated developing device comprises a mass of toner material and a mass of carrier material and after being supplied into the lower chamber 25, cascades under the force of the screw feeder 30 onto the outer peripheral surface of the developing sleeve 22.

The developing material supplied onto the developing sleeve 22 is retained in the form of, a magnetic brush of bristles on the outer peripheral surface of the developing sleeve due to the magnetic forces that are exerted thereon by the magnetic roller 23. During the rotation of the developing sleeve 22, the magnetic brush of bristles is transported in a direction, shown by the arrow a in FIG. 6, towards a developing station S where a minimum space is established between the developing sleeve 22 and the photoreceptor drum 100. During the transportation, the magnetic brush of bristles passes through the front opening 17, then through a spacing 27, delimited between a front wall of the casing 21 and the outer peripheral surface of the developing sleeve 22, and finally through a regulating gap delimited similarly between the developing sleeve 22 and a bristle height regulating plate 31 for regulating the height of the magnetic brush of bristles thereby adjusting the amount of developing material supplied towards the developing station S. A portion of the developing material forming the magnetic brush of bristles which has been squeezed by the regulating plate 31 and is not therefore transported towards the developing station S flows backwards in a direction counter to the direction a of rotation of the developing sleeve 22, returning through the spacing 27 into the upper chamber 24 for mixing with the developing material within the upper chamber 24.

The developing material within the upper chamber 24 is, during the rotation of the screw feeder 29, conveyed in the direction Y1 while being successively forced to flow into the lower chamber 25 through the rear opening 28 remote from the developing sleeve 22.

The prior art developing device having the structure described with reference to FIGS. 6 and 7, has some problems inherent therein. Specifically, that portion of the developing material, carried by the developing sleeve 22 to the developing station S, which has been left unused in the formation of a powder image on the photoreceptor drum 100 is not removed from the developing sleeve 2 even after it has been moved past the developing station S during the continued rotation of the developing sleeve 22. During the next succeeding cycle of rotation of the developing sleeve 22, the developing material is supplied onto the developing sleeve 22 while the latter still retains that portion of the developing material which was not used during the previous cycle of rotation of the developing sleeve 22 and was left unremoved therefrom.

Because of this, stratification of the developing material magnetically attracted onto the outer peripheral surface of the developing sleeve 22 has been found to occur. Considering that the magnetic brush of bristles is equivalent to a layer of developing material on the outer peripheral surface of the developing sleeve 22, and, also considering that that portion of the developing material having moved past the developing station S without being completely used for the formation of the powder image on the photoreceptor drum 100 contains toner particles of a density reduced as compared with that of the toner particles in the developing material supplied to the developing station S, the supply of the developing material for use in the next succeeding cycle of rotation of the developing sleeve 22 results in a layer of developing material containing a lower density of toner particles being formed at a lower region thereof adjacent the outer peripheral surface of the developing sleeve 22 and a higher density of toner particles being formed at an upper region thereof remote from the outer peripheral surface of the developing sleeve 22.

Moreover, most of the concentrated toner particles in the upper region of the layer of developing material are, during the passage of the magnetic brush of bristles underneath the regulating plate 31 and, hence, through the regulating gap, squeezed from the lower region of the same layer of developing material. Therefore, the developing material containing a reduced density of the toner particles tends to be supplied towards the developing station S. This is problematic in that, when a number of copies are repeatedly made from an identical original, the image density is abruptly reduced with the increase in the number of the copies, constituting a cause of a reduction in image quality.

Also, in the prior art developing device, a number of similar recirculating paths 32 are formed around the partition wall 26 and over the lengthwise direction of any one of the screw feeders 29 and 30 for facilitating the recirculation of the developing material from the upper chamber 24 back to the upper chamber 24 first through the rear opening 28, then around the screw feeder 30 in the lower chamber 25 and finally through the front opening 17 as indicated by the arrow-headed line in FIGS. 6 and 7. The developing material within each of the upper and lower chambers 24 and 25 is of course conveyed a small distance by the associated screw feeder 29 or 30 in the associated direction Y1 or Y2 and is first forced by the screw feeder 29 to fall into the lower chamber 25 through the rear opening 28. Then the material is readily scooped up by the screw feeder 30 so as to enter the upper chamber 24 through the front opening 17.

The presence of the number of the recirculation paths 32 has been found to adversely affect the fluidity and the dispersibility of the developing material. When an original having a solid area at a location presumably corresponding to one of the opposite ends of the developing sleeve 22 is copied on a copying paper, the solid area will be reproduced on the copying paper in a reduced image density and the subsequent copying of character images results in the lowering of the character reproducibility.

When a toner sensor for detecting the concentration of the toner component in the developing material is disposed in the vicinity of one of the opposite ends, and when a mass of toner particles is replenished, the toner sensor will require a relatively long time before it detects the concentration of the toner particles then replenished. Therefore, it often occurs that an operator may excessively replenish the toner particles, resulting in the creation of an over toner condition which may bring about the formation of fog and/or toner dusting. Once this occurs not only is the copy quality reduced, but the interior of the machine is also contaminated.

Conversely, even when an area where the concentration of the toner particles is reduced is formed, the reduction in toner concentration cannot be quickly detected, and the inflow of the toner particles into that area where the toner concentration is reduced tends to be delayed, resulting in the enhancement of the reduced image quality. Yet, the insufficient fluidity of the toner particles often constitutes a cause of insufficient charging of the toner particles.

SUMMARY OF THE INVENTION

Accordingly, the present invention has been developed with a view to substantially eliminate the above-discussed problems inherent in the prior art developing device and has as its essential object to provide an improved developing device wherein the developing material once having passed through the developing station can be removed from the developing sleeve into the lower chamber so that, during the next succeeding cycle of rotation of the developing sleeve, the developing material containing the toner particles and the carrier particles mixed in a predetermined proportion can be supplied towards the developing station by means of the developing sleeve.

Another object of the present invention is to provide an improved developing device of the type referred to above, wherein during the conveyance of the developing material within the upper and lower chambers the mixing of the developing material within the upper chamber and that within the lower chamber can be advantageously minimized thereby exhibiting both a satisfactory conveyance of the developing material within the developing device and an improved dispersibility of the developing material newly replenished.

A further object of the present invention is to provide an improved developing device of the type referred to above, wherein the toner sensor can quickly detect the concentration of the toner particles because of the quick dispersion of the toner particles immediately after the replenishment thereof, thereby facilitating a reliable detection.

To this end, the present invention provides a developing device of a type which comprises a casing having a sleeve chamber, an upper chamber and a lower chamber defined therein, the sleeve chamber being positioned adjacent a latent image carrier medium with the upper and lower chambers disposed one above the other and on one side of the sleeve chamber remote from the latent image carrier medium. A developing sleeve is housed within the sleeve chamber with a portion of the outer peripheral surface thereof exposed towards and spaced a predetermined distance from the latent image carrier medium to define a developing station. A conveyance means which may be a screw feeder is operatively housed within each of the upper and lower chambers, and the respective conveyance means within the upper and lower chambers are adapted to be driven in opposite directions so that developing material within the upper and lower chambers can be conveyed in respective directions opposite to each other and generally parallel to the developing sleeve.

The upper and lower chambers in the casing are separated from each other by a generally elongated partition wall member extending generally parallel to the developing sleeve and communicate with each other through a port defined in a portion of the partition wall member. The portion may be a downstream end of the partition wall member with respect to the direction of conveyance of the developing material within the lower chamber.

Within the developing sleeve, a plurality of magnets are accommodated so as to extend in a direction longitudinally of the developing sleeve and are positioned circumferentially of the developing sleeve. A weak magnetic pole is disposed at a region confronting the conveyance means accommodated within the lower chamber, and a strong magnetic pole is disposed, instead of a weak magnetic pole, at a region corresponding to the port in the partition wall member and longitudinally of the weak magnetic pole.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE PREFERRED EMBODIMENTS

Figure 1:
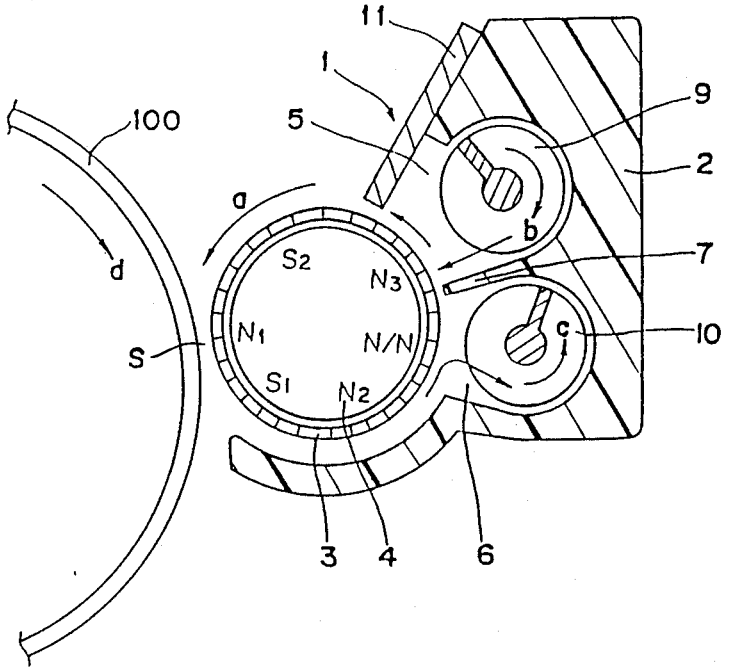
FIGS. 1 and 2 are side sectional views of a developing device embodying the present invention, as viewed in a direction perpendicular to the axis of rotation of a photoreceptor drum at different locations, respectively.
Figure 2:
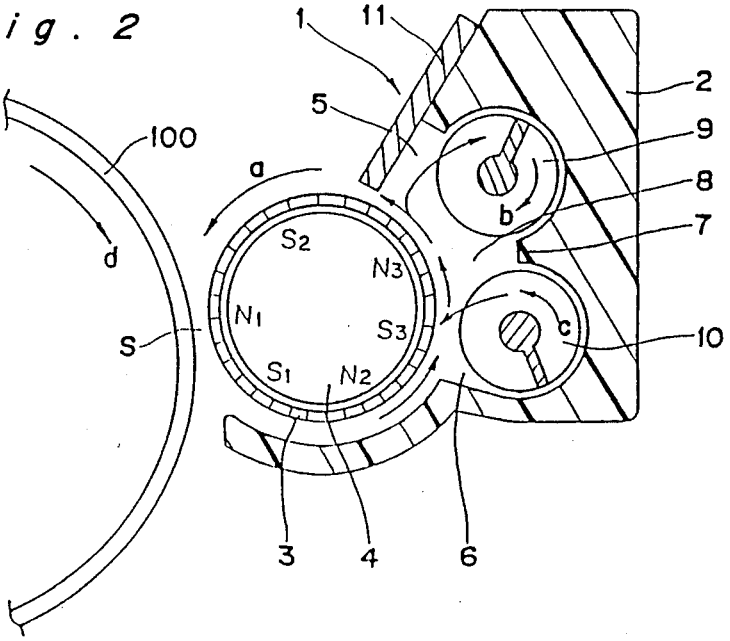
Figure 3:
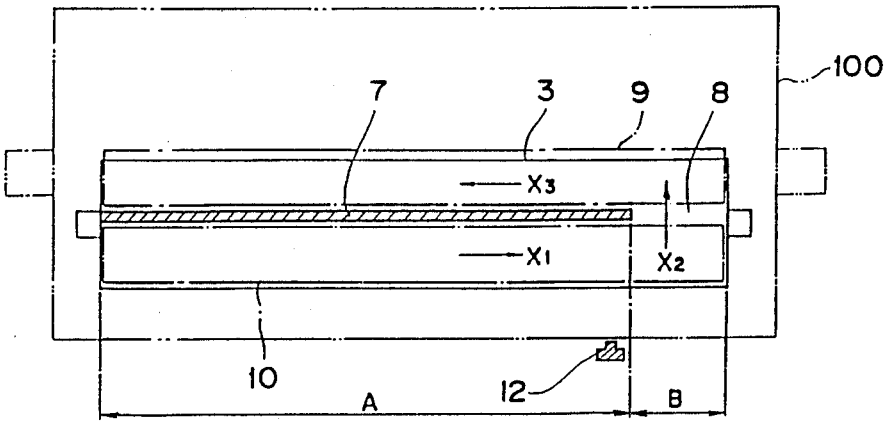
FIG. 3 is a schematic top plan view showing the location of a port in a partition wall member relative to screw feeders in respective upper and lower chambers in the developing device.

Referring first to FIGS. 1 to 3, a developing device 1 for use in an image forming apparatus comprises a casing 2 having a sleeve chamber in which an upper chamber 5 and a lower chamber 6 are defined. The sleeve chamber is positioned adjacent a rotatably supported photoreceptor drum 100 while the upper and lower chambers 5 and 6 are positioned one above the other and on one side of the sleeve chamber remote from the photoreceptor drum. A developing sleeve 3 is housed within the sleeve chamber with a portion of the outer peripheral surface thereof exposed to and spaced a predetermined distance from the photoreceptor drum 100 to define a developing station S. The developing sleeve 3 supported within the sleeve chamber rotates in one direction, as shown by the arrow a, counter to the direction of rotation of the photoreceptor drum 100 shown by the arrow d.

The upper and lower chambers 5 and 6 in the casing 2 are separated from each other by a generally elongated partition wall 7 extending generally parallel to the developing sleeve 3. These upper and lower chambers 5 and 6 communicate with each other through a port 8 defined in a portion of the partition wall member. This partition wall 7 may be an integral part of the wall forming the casing 2 and is so formed as to protrude from a wall portion of the casing 2, which is situated on one side of the upper and lower chambers 5 and 6 remote from the developing sleeve 3, towards the developing sleeve 3 and terminates at a location spaced a minute distance inwardly from the outer peripheral surface of the developing sleeve 3. The partition wall 7 so formed lies between upper and lower screw feeders 9 and 10 operatively housed within the upper and lower chambers 5 and 6, respectively.

The upper screw feeder 9 within the upper chamber 5 is adapted to be driven in a direction shown by the arrow b so that developing material within the upper chamber 5 can be conveyed in a direction X3 along a conveyance path generally parallel to the developing sleeve 3. On the other hand, the lower screw feeder 10 within the lower chamber 6 is adapted to be driven in a direction, shown by the arrow c, counter to the direction b of rotation of the upper screw feeder 9, so that developing material within the lower chamber 6 can be conveyed in a direction X1, counter to the direction X3, along a conveyance path generally parallel to the developing sleeve 3.

With the upper and lower screw feeders 9 and 10 housed respectively within the upper and lower chambers 5 and 6, the position of the port 8 defined in the partition wall 7 places the upper and lower chambers 5 and 6 in communication and is so selected as to lie at one of the opposite ends of the partition wall 7 on an upstream side with respect to the direction of conveyance of developing material within the upper chamber 5 and on a downstream side with respect to the direction of conveyance of developing material within the lower chamber 6 as best shown in FIG. 3.

A generally cylindrical magnetic roller 4 is fixedly housed within the developing sleeve 3 in a coaxial relation therewith. This magnetic roller 4 has a plurality of magnets disposed therein so as to extend in a direction lengthwise thereof and positioned circumferentially thereof. As best shown in FIG. 3, the magnetic roller 4 has regions A and B lying in a direction lengthwise thereof, the region B corresponding to that end of the partition wall 7 where the port 8 is defined while the region A corresponds to the remaining portion of the partition wall 7. Both of the regions A and B fall within a coverage zone in which the developing sleeve 3 participates in the development of a powder image on the photoreceptor drum 100.

The arrangement of magnetic poles at one of the regions A and B on the magnetic roller 4 is different from that at the other of the regions A and B on the magnetic roller 4 in a manner which will now be described.

As best shown in FIG. 1, at the region A, a magnetic pole N1 is disposed so as to confront the developing station S or the photoreceptor drum 100; an identically magnetized portion N/N in which weak magnetic poles N are arranged in a side-by-side fashion is disposed so as to confront the lower screw feeder 10 within the lower chamber 6; a magnetic pole N3 is disposed so as to confront the upper screw feeder 9 within the upper chamber 5; a magnetic pole S2 is disposed between the magnetic poles N1 and N3; and magnetic poles S1 and N2 are disposed between the magnetic poles N1 and the identically magnetized portion N/N.

On the other hand, at the region B, while magnetic poles are disposed similar to the arrangement at region A as far as the magnetic poles N1 to N3, S1 and S2 are concerned, a magnetic pole S3 is disposed longitudinally of the identically magnetized portion N/N.

Figure 4:
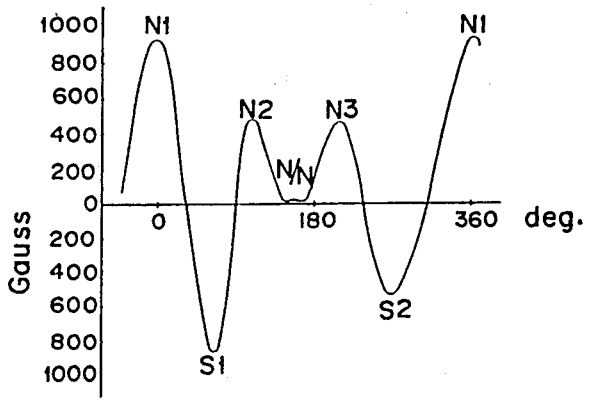
FIGS. 4 and 5 are graphs illustrating respective distributions of magnetic forces at different portions of a magnetic roller used in the developing device.
Figure 5:
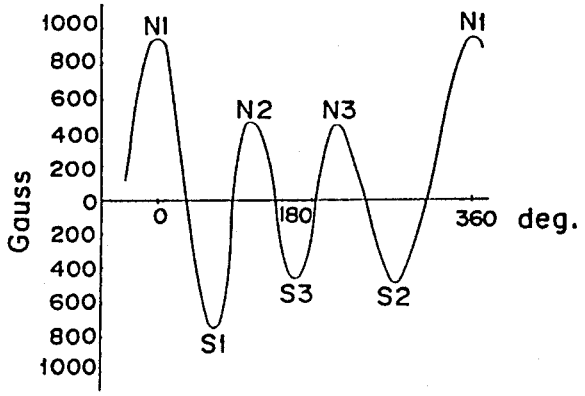
Figure 6:
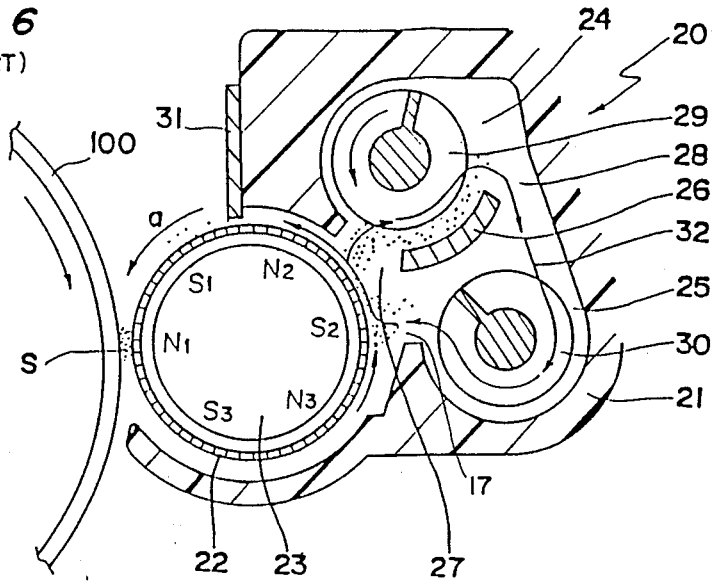
Fig. 6 (PRIOR ART)
FIG. 6 is a side sectional view of the prior art developing device as viewed in a direction perpendicular to the axis of rotation of the photoreceptor drum.
Figure 7:
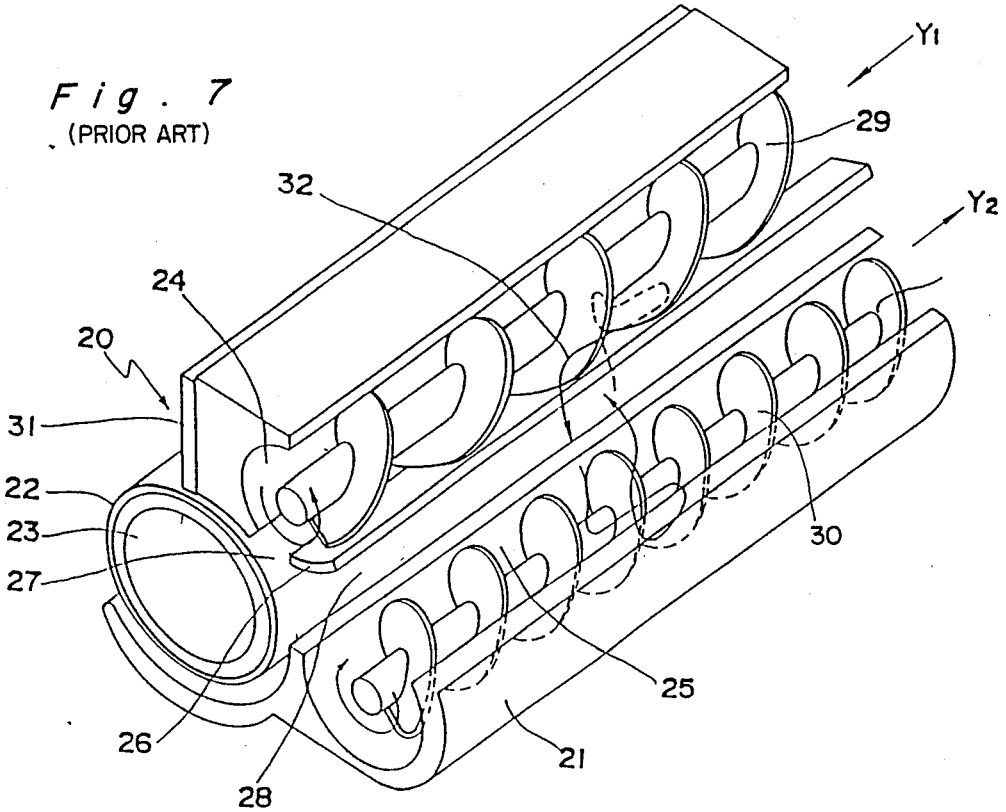
Fig. 7 (PRIOR ART)
FIG. 7 is a perspective view of a casing in which the screw feeders are disposed in the prior art developing device.

Magnetic forces emanating from these magnetic poles and a distribution of the magnetic forces are illustrated in FIGS. 4 and 5.

While the developing device 1 according to the present invention is so constructed as hereinbefore described, the developing device 1 operates in the following manner with the use of two-component type of developing material comprising a toner component and a carrier component.

The developing material within the lower chamber 6 is conveyed by the lower screw feeder 10 from one end towards the opposite end of the lower chamber 6 in the direction X1. At this time, although the developing material within the lower chamber 6 is affected by a force produced by the lower screw feeder 10 that urges it towards the developing sleeve 3, the identically magnetized portion N/N confronts the lower screw feeder 10 and effects a magnetic force of repulsion tending to urge the developing material away from the developing sleeve 3. Therefore, the developing material within the lower chamber 6 is not retained on the developing sleeve 3.

As the developing material conveyed within the lower chamber 6 in the direction X1 approaches the region B, the developing material is attracted onto and is retained on the developing sleeve 3 by the magnetic force generated by the magnetic pole S3. This is because, as shown in FIG. 2, at the region B, the identically magnetized portion N/N does not confront the lower screw feeder 10 and, instead, the magnetic pole S3 confronts the lower screw feeder 10. The developing material so retained on the developing sleeve 3 is then conveyed in a direction, shown by X2, by the rotation of the developing sleeve 3.

Thereafter, the developing material is, during the rotation of the developing sleeve 3, transported towards a regulating gap defined between the outer peripheral surface of the developing sleeve 3 and a bristle height regulating plate 11 carried by the casing 2. During the passage of the developing material through the regulating gap, most of the developing material being rotated with the developing sleeve 3 is squeezed off and falls into the upper chamber 9. The developing material squeezed and then falling into the upper chamber 9 is conveyed by the upper screw feeder 9 from one end to the opposite end of the upper chamber 9 in the direction X3 and is, during the conveyance in the direction X3, supplied onto the outer peripheral surface of the developing sleeve 3.

It is to be noted that the developing material when conveyed within each of the upper and lower chambers 5 and 6 is uniformly mixed to such an extent that the toner particles in the developing material are electrostatically charged to a required value.

On the other hand, the developing material having passed underneath the regulating plate 11, that is, through the regulating gap, is, during the continued rotation of the developing sleeve 3, transported to the developing station S at which the toner particles are applied onto the outer peripheral surface of the photoreceptor drum 10 to develop an electrostatic latent image into a visible powder image.

The developing material having been used for the formation of the visible powder image on the photoreceptor drum 10 and having the concentration of the toner particles thereof reduced, consequently is transported along a lower area of the outer peripheral surface of the developing sleeve 3. When such developing material confronts the lower chamber 6, it is allowed to fall into the lower chamber 6 under the influence of the magnetic field of repulsion developed by the identically magnetized portion N/N. The developing material so falling into the lower chamber 6 is again conveyed successively in the directions X1, X2 and X3. Summarily then, the developing material on the outer peripheral surface of the developing sleeve 3 is, when at the position where it confronts the lower chamber 6, removed from the sleeve and the developing sleeve is, at the position where it confronts the upper chamber 5, supplied with the developing material containing the toner particles having the electrostatic charge increased due to the mixing thereof within the upper chamber 5.

Replenishment of the toner particles in the developing device 1 is carried out adjacent the upstream side of the lower chamber 6. The replenished toner particles are mixed with the carrier particles during the conveyance thereof within the lower chamber 6 and have the required electrostatic charge imparted thereto.

A toner sensor 12 for detecting the concentration of the toner particles in the developing material is, as best shown in FIG. 3, disposed in the vicinity of the boundary between the regions A and B. Accordingly, since the replenished toner particles are sufficiently dispersed before they reach the boundary between the regions A and B and the concentration of the toner particles becomes uniform in the developing material, the concentration of the toner particles can be accurately detected, making it possible to accomplish proper toner replenishment.

Thus, according to the present invention, it is clear that, since the developing material once having passed through the developing station can be recovered from the developing sleeve in the lower chamber, the developing material containing the toner particles and the carrier particles mixed in a predetermined proportion can be supplied to the developing station by means of the developing sleeve. This is advantageous in that, even when an original having a solid black area is copied on a copying paper, the image corresponding to the solid black area can be reproduced in a stabilized manner so as to exhibit a proper image density.

Also, since during the conveyance of the developing material within the upper and lower chambers the mixing of the developing material within the upper chamber and that within the lower chamber can be advantageously minimized, both a satisfactory conveyance of the developing material within the developing device and an improved dispersibility of the newly replenished developing material can be realized. Accordingly, the toner particles are repeatedly held in frictional contact with the carrier particles and are, while electrostatically charged to the potential required for the development of the powder image, supplied to the developing station, making it possible not only to produce a copied image free from fog, but also to minimize the scattering of the toner thereby maintaining the interior of the machine clean.

Moreover, the replenished toner particles can be quickly dispersed over an entire region and the concentration thereof can be detected by the toner sensor in the dispersed state. Therefore, a reliable result of detection can be obtained and a proper toner replenishment can be performed.

Figure 8:
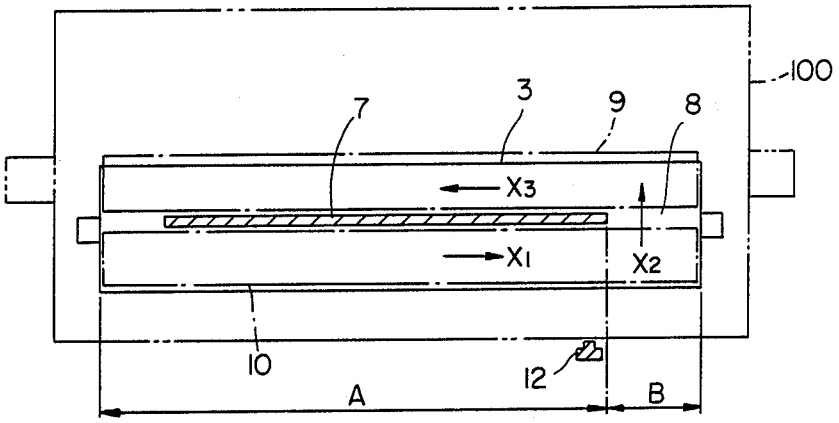
FIG. 8 is a schematic top plan view showing the location of ports in a partition wall member relative to screw feeders in respective upper and lower chambers in the developing device according to another embodiment of the invention.

Although the present invention has fully been described in connection with the preferred embodiment thereof with reference to the accompanying drawings, it is to be noted that various changes and modifications will be apparent to those skilled in the art. By way of example, although in the foregoing embodiment reference has been made to the formation of only one port in the partition wall, another similar port may be formed in the partition wall at a location opposite to such port, i.e., on the opposite end of the partition wall on the upstream side with respect to the direction of conveyance within the lower chamber, as shown schematically in FIG. 8.

Figure 9:
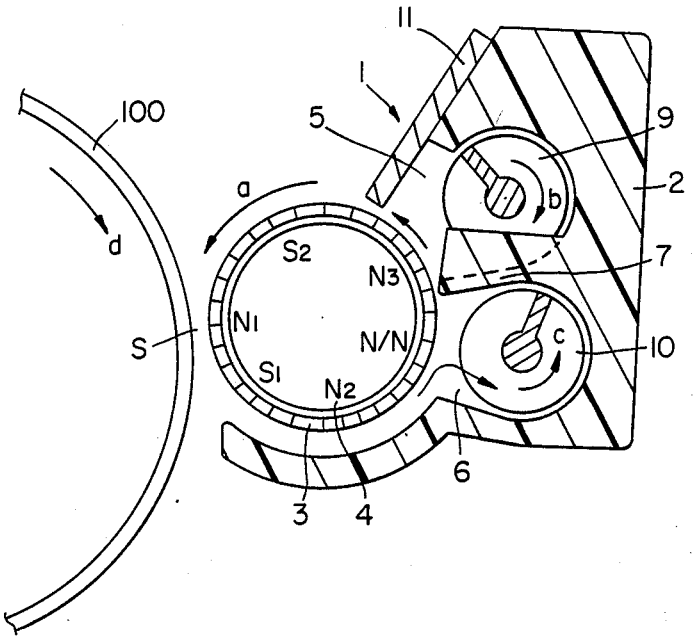
FIGS. 9 and 10 are side sectional and schematic top plan views showing an upright wall member extending from the upstream end of the partition wall according to another embodiment of the present invention.
Figure 10:
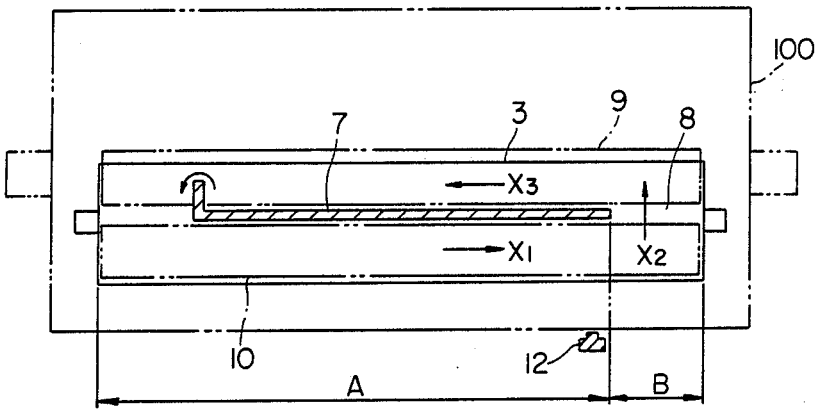

Also, in the illustrated embodiment, an end portion of the partition wall confronting the port may be formed with an upright wall protruding upwardly into the upper chamber so that only the developing material which flows over the upright wall can be allowed to fall into the lower chamber, as shown schematically in FIGS. 9 and 10.

Although in the foregoing embodiment the regions A and B have been described as falling within the coverage zone in which the developing sleeve 3 participates in the development of a powder image on the photoreceptor drum 100, only the region B may be defined outside such a coverage zone.

Accordingly, such changes and modifications are to be understood as included within the scope of the present invention as defined by the appended claims unless they depart therefrom.

We claim:

1. A developing device comprising:

a latent image carrier means for carrying a latent image;

a casing having a sleeve chamber in which an upper chamber and a lower chamber are defined, the sleeve chamber being positioned adjacent the latent image carrier means with the upper and lower chambers disposed one above the other and on a side of the sleeve chamber remote from the latent image carrier means;

a developing sleeve rotatably supported in the device and housed within the sleeve chamber for delivering developing material to the latent image carrier means at a developing station, a fixed location defined at the outer peripheral surface of the sleeve confronting and spaced a predetermined distance from the latent image carrier means to define the developing station;

a conveyance means operatively housed within each of the upper and lower chambers for conveying developing material within the upper and lower chambers in respective directions opposite to each other and generally parallel to the central longitudinal axis of the developing sleeve;

a partition wall member extending generally parallel to the developing sleeve and separating said upper and lower chambers from each other, said partition wall defining a port at an end thereof that is downstream with respect to the direction of conveyance of the developing material within the lower chamber, said port placing the upper and lower chambers in communication with each other; and a plurality of magnets accommodated inside the developing sleeve and extending in a direction longitudinally of the developing sleeve while positioned circumferentially of the developing sleeve, said plurality of magnets including a weak magnetic pole disposed at a region confronting the conveyance means housed within the lower chamber and a strong magnetic pole generating a magnetic force of a magnitude greater than that generated by said weak magnetic pole, said strong magnetic pole disposed longitudinally of said weak magnetic pole in said sleeve at a region confronting both the conveyance means housed within the lower chamber and the port defined by the partition wall member.

2. The developing device as claimed in claim 1, wherein the partition wall member defines another port at an upstream end thereof opposite to said downstream end.

3. The developing device as claimed in claim 1, wherein the developing sleeve is rotatable in a predetermined direction of rotation to deliver developing material to the latent image carrier means at the developing station, and wherein said plurality of magnets includes a magnetic pole adjacent to said weak magnetic pole as taken in said predetermined direction of rotation and having the same polarity as the weak magnetic pole.

4. The developing device as claimed in claim 2, wherein the developing sleeve is rotatable in a predetermined direction of rotation to deliver developing material to the latent image carrier means at the developing station, and wherein said plurality of magnets includes a magnetic pole adjacent to said weak magnetic pole as taken in said predetermined direction of rotation and having the same polarity as the weak magnetic pole.

5. The developing device as claimed in claim 1, wherein the developing sleeve is rotatable in a predetermined direction of rotation to deliver developing material to the latent image carrier means at the developing station, and wherein said plurality of magnets includes a magnetic pole adjacent to said weak magnetic pole as taken in a circumferential direction of the sleeve opposite to said predetermined direction of rotation and having the same polarity as the weak magnetic pole.

6. The developing device as claimed in claim 2, wherein the developing sleeve is rotatable in a predetermined direction of rotation to deliver developing material to the latent image carrier means at the developing station, and wherein said plurality of magnets includes a magnetic pole adjacent to said weak magnetic pole as taken in a circumferential direction of the sleeve opposite to said predetermined direction of rotation and having the same polarity as the weak magnetic pole.

7. The developing device as claimed in claim 1, wherein the developing sleeve is rotatable in a predetermined direction of rotation to deliver developing material to the latent image carrier means at the developing station, and wherein said plurality of magnets includes a magnetic pole adjacent to said strong magnetic pole as taken in a circumferential direction of the sleeve opposite to said predetermined direction of rotation and having a polarity that is opposite to that of said strong magnetic pole.

8. The developing device as claimed in claim 2, wherein the developing sleeve is rotatable in a predetermined direction of rotation to deliver developing material to the latent image carrier means at the developing station, and wherein said plurality of magnets includes a magnetic pole adjacent to said strong magnetic pole as taken in a circumferential direction of the sleeve opposite to said predetermined direction of rotation and having a polarity that is opposite to that of said strong magnetic pole.

9. The developing device as claimed in claim 1, wherein said weak and said strong magnetic poles have respective polarities that are opposite to one another.

10. The developing device as claimed in claim 2, wherein said weak and said strong magnetic poles have respective polarities that are opposite to one another.

11. The developing device as claimed in claim 1, wherein the developing sleeve is rotatable in a predetermined direction of rotation to deliver developing material to the latent image carrier means at the developing station, the plurality of magnets includes a magnetic pole adjacent to said weak magnetic pole as taken in said predetermined direction of rotation, and the partition wall lies in a plane extending between the weak magnetic pole and said magnetic pole adjacent thereto.

12. The developing device as claimed in claim 2, wherein the developing sleeve is rotatable in a predetermined direction of rotation to deliver developing material to the latent image carrier means at the developing station, the plurality of magnets includes a magnetic pole adjacent to said weak magnetic pole as taken in said predetermined direction of rotation, and the partition wall lies in a plane extending between the weak magnetic pole and said magnetic pole adjacent thereto.

13. The developing device as claimed in claim 1, wherein each said conveyance means comprises a rotatable screw conveyor.

14. The developing device as claimed in claim 2, wherein each said conveyance means comprises a rotatable screw conveyor.

15. The developing device as claimed in claim 2, and further comprising an upright wall extending vertically upwardly from the upstream end of said partition wall.

* * * * *